US005470200A

United States Patent [19]

Tupov et al.

[11] Patent Number: 5,470,200

[45] Date of Patent: Nov. 28, 1995

[54] GUIDE VANES FOR AXIAL FANS

[75] Inventors: Vladimir Tupov, Moscow, Russian Federation; Patrick Nilsson; Börje Nilsson, both of Växjö, Sweden

[73] Assignee: ABB Flakt Aktiebolag, Stockholm, Sweden

[21] Appl. No.: 175,356

[22] PCT Filed: Jun. 26, 1992

[86] PCT No.: PCT/SE92/00481

§ 371 Date: Mar. 17, 1994

§ 102(e) Date: Mar. 17, 1994

[87] PCT Pub. No.: WO93/01415

PCT Pub. Date: Jan. 21, 1993

[30] Foreign Application Priority Data

Jul. 9, 1991 [SE] Sweden ..... 9102150

[51] Int. Cl.[6] ..... F01D 1/02

[52] U.S. Cl. ..... 415/195; 415/194

[58] Field of Search ..... 415/208.2, 209.1, 415/211.2, 220, 210.1, 194, 195

[56] References Cited

U.S. PATENT DOCUMENTS

| | | | |
|---|---|---|---|
| 821,347 | 5/1906 | Elling | 415/195 |
| 2,839,239 | 6/1958 | Stalker | 415/194 |
| 3,883,264 | 5/1975 | Rao | 415/209.1 |
| 5,152,661 | 10/1992 | Sheets | 415/209.1 |
| 5,246,339 | 9/1993 | Bengtsson | 415/211.2 |

FOREIGN PATENT DOCUMENTS

| | | | |
|---|---|---|---|
| 1200484 | 12/1959 | France | 415/195 |

*Primary Examiner*—Edward K. Look
*Assistant Examiner*—Mark Sgantzos
*Attorney, Agent, or Firm*—Oblon, Spivak, McClelland, Maier & Neustadt

[57] ABSTRACT

A guide vane arrangement for axial fans, intended to translate the rotational component of the gas flow velocity after passage through the impeller (1) into a substantially axial velocity, including a ring (2) of guide vanes disposed downstream of the fan and in spaced relationship therewith. Alternate guide vanes are axially displaced with respect to the remaining ones, so that alternate guide vanes are at a first axial distance from the fan and the remainder are at a second axial distance from the fan. As an alternative, alternate guide vanes have a portion of the end part facing towards the fan removed, so that the forward edge of alternate guide vanes is at a first distance from the fan and the remaining guide vanes are at a second axial distance, and the guide vanes are non-uniformly distributed along the periphery of the ring.

11 Claims, 4 Drawing Sheets

GUIDE VANES FOR AXIAL FANS

TECHNICAL FIELD

The following invention relates to a guide vane arrangement for axial fans, intended to convert the rotational component in the gas flow velocity after passage through the impeller into a substantially axial velocity, the arrangement including a ring of guide vanes disposed downstream of the fan and in spaced relationship therewith.

BACKGROUND ART

The gas flow downstream of the impeller of an axial fan normally rotates. The rotational energy can be translated into useful energy by a guide vane arrangement on the outlet side of the fan, this arrangement converting the rotational velocity to an axial velocity component. The pressure is raised in this way, and the efficiency of the fan increases. Normally, however, the sound level also increases at the same time.

The sound from a fan comprises tonal components, i.e. tones with discrete frequencies and a wide band noise with a continuous frequency spectrum. Considerable efforts have been made primarily to lower the tonal components, by a suitable arrangement and embodiment of guide vanes on the output side of the fan.

It is accordingly a general understanding that the noise generated decreases with increasing distance between the impeller and guide vanes, see M. J. Benzakein, J. Acoust. Soc. Am. 51 (1972), 1427–1438 and W. Neise, Proc. INTER-NOISE 1988, pp 767–776. It has been found, however, this is not always applicable.

A guide vane is described in the Swedish patent 8802136-5, which has improved aerodynamic and acoustic properties.

It has also been found earlier that a non-uniform distribution of the guide vanes in the ring of guide vanes can give rise to certain acoustic improvements, although it has been found that large deviations from a uniform distribution of the guide vanes give rise to aerodynamic problems.

It is also known that certain acoustic characteristics can be improved by a portion being cut out from alternate guide vanes in their the forward portions.

FIG. 1 illustrates how the strength in an individual tone can be reduced by displacing the guide vanes in the circumferential direction of the guide vane ring. It will also be seen from the same figure that the noise at higher frequencies over about 500 Hz also increases at the same time. The measurement has been made for a fan R.P.M. of n=970 and a displacement of alternate guide vanes of $\beta=10°$ and $\beta=0°$.

DISCLOSURE OF THE INVENTION

The object of the present invention is to lower individual, disturbing tones in the fan sound, as well as lower the general noise level in a simple way.

The first-mentioned object is achieved with a guide vane ring of the kind mentioned in the introduction, and with characteristics disclosed hereinbelow 1.

The second object is achieved by a further development of the inventive guide vane arrangement, in which alternate guide vanes are axially displaced relative the remaining ones, so that alternate guide vanes are at a first axial distance from the fan, and the remainder at a second axial distance, simultaneously as the guide vanes are non-uniformly distributed in the guide vane ring circumference. Preferably, alternate guide vanes are displaced in the circumferential direction relative to the remaining guide vanes with a constant displacement so that the distance in the circumferential direction between juxtaposed guide vanes alternates between two given values. This arrangement reduces both individual tones and the general wide band noise from the fan. In addition, this combination of axial displacement and circumferential displacement of the guide vanes provides improved efficiency of the fan, compared with the case using a guide vane arrangement with only axial displacement of the guide vanes, or only rotation of the vanes in the circumferential direction.

By the combination of measures according to this further development of the apparatus in accordance with the invention, there are achieved highly important advantages, both with respect to acoustics and efficiency, considerably exceeding the effects achieved by the individual measures of axial displacement or circumferential rotation of the guide vanes.

In accordance with another advantageous embodiment of the inventive apparatus, the axial displacement of the guide vanes is in the interval 0,4–0,7 $l/l_{ch}$, preferably 0,5 $l/l_{ch}$, where l denotes the magnitude of the displacement and $l_{ch}$ the length along the guide vane.

In accordance with yet another advantageous embodiment, the displacement in the circumferential direction is in the interval 5°–15°, and is preferably 10°.

In accordance with a further advantageous embodiment of the apparatus in accordance with the invention, the guide vane ring arrangement is divided into two rings axially in tandem, alternate guide vanes being carried by one ring and the other guide vanes by the other ring, the rings being axially displaceable relative to each other or radially rotatable relative each other about a common axis. It is thus possible to adjust the guide vane arrangement in a simple way to achieve optimum conditions.

In accordance with a further advantageous embodiment of the invention, in the portion facing towards the impeller the guide vanes are designed with a web configuration between the radially outer and inner portions of the guide vane such that the arcuate length along the single-curved guide vane at the level of the web is shorter than at said mentioned outer and inner portions.

BRIEF DESCRIPTION OF THE DRAWINGS

Emodiments of the arrangements in accordance with the invention, selected as examples, will now be described in greater detail and with reference to the accompanying drawings, wherein.

BEST MODE FOR CARRYING OUT THE INVENTION

Figure 2:
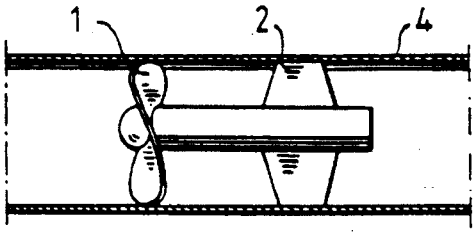
FIG. 2 illustrates an axial fan with guide vanes arranged downstream of the fan.

FIG. 2 illustrates an axial fan installed in a duct 4 and having a guide vane ring 2 arranged in spaced relationship with, and downstream of the impeller 1. The number of guide vanes is preferably between 0.5 and 2.1 times the number of blades in the impeller.

Figure 1:
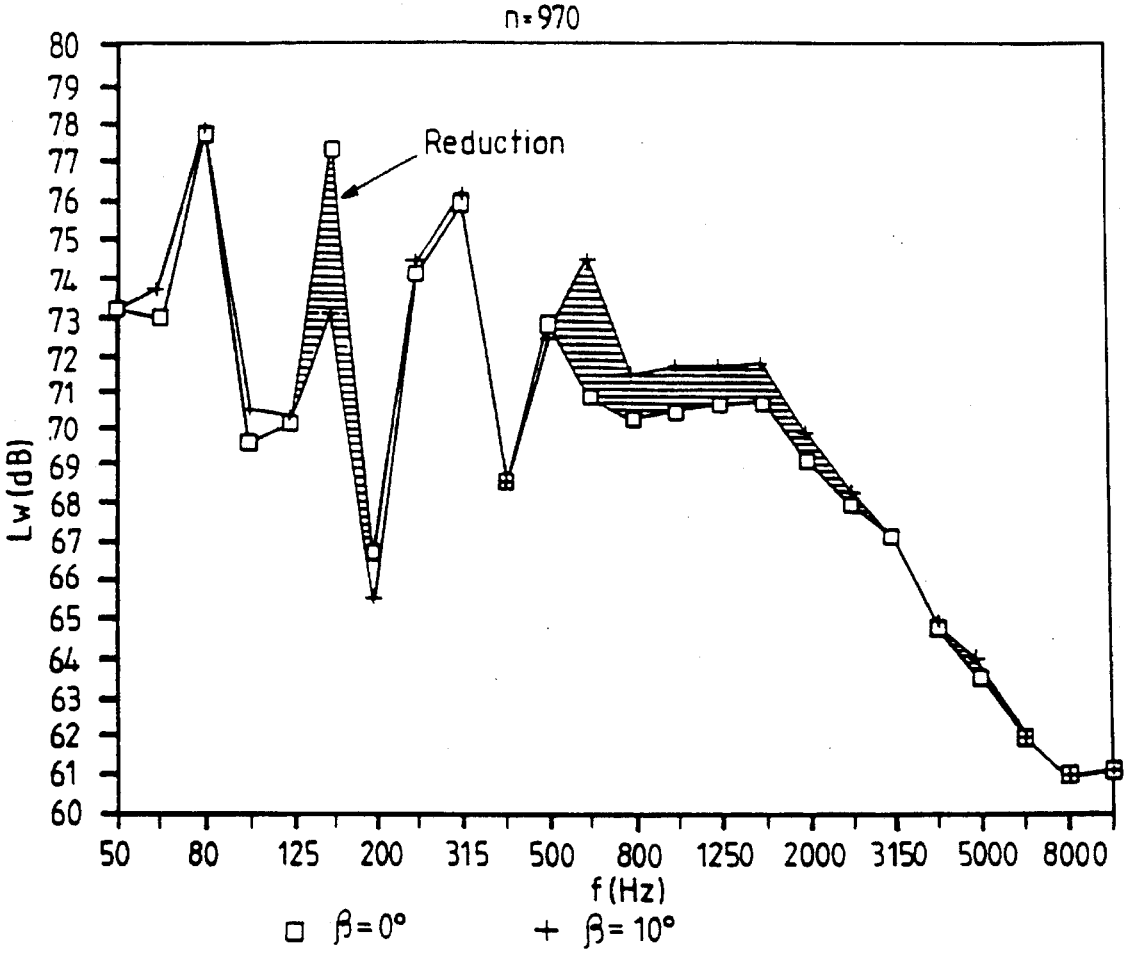
Fig. 1 PRIOR ART
FIG. 1 illustrates the effect on the sound level from the fan when alternate guide vanes are displaced in the circumferential direction in accordance with prior art.
Figure 3A:
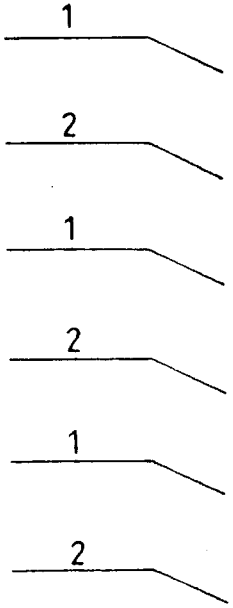
Fig.3a PRIOR ART
FIG. 3 schematically illustrates five different guide vane arrangements which include: a) guide vanes arranged uniformly according to the prior art, b) alternate guide vanes displaced in the circumferential direction of the guide vane ring according to the prior art, c) alternate guide vanes axially displaced in accordance with the invention, d) a combination of axial displacement and rotation of the guide vane ring in a circumferential direction in accordance with the invention, e) the combination of the displacement in the circumferential direction and the provision of a cut-out in alternate guide vanes in accordance with the invention.
Figure 3B:
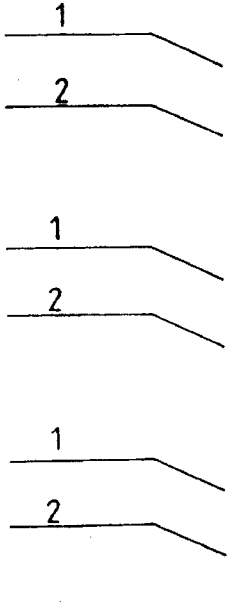
Fig.3b PRIOR ART

In FIG. 1 the effects on the sound from a fan with guide vane arrangements according to the principles shown in FIGS. 3*a* and 3*b* are compared under the conditions given above. It will be seen from FIG. 1 that displacement Lw (dB) of alternate guide vanes in the circumferential direction of the guide vane ring according to FIG. 3*b* results in a heavy decrease of a tone at the blade frequency f (Hz) of 160 Hz, while there is an increase in the noise level for frequencies over about 500 Hz.

Figure 3C:
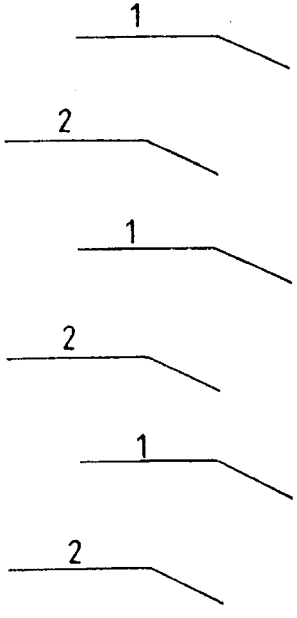
Figure 4:
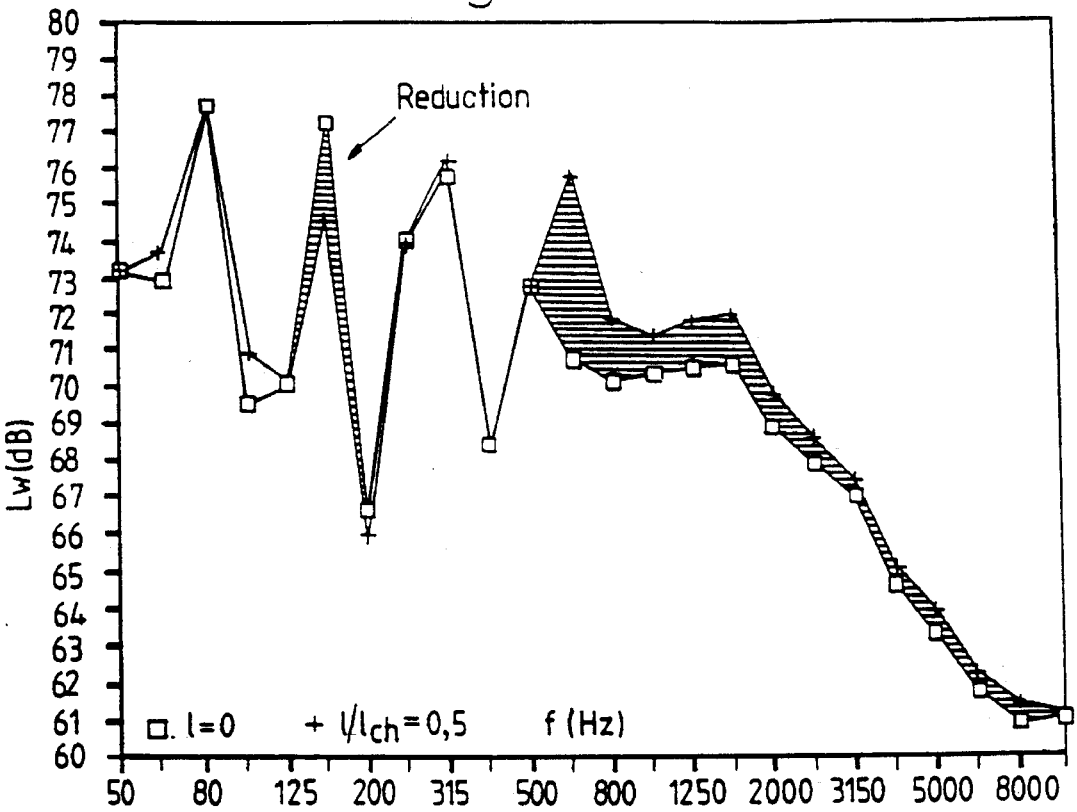
FIG. 4 illustrates the effect on the sound from the fan resulting from the axial displacement of the alternate guide vanes in accordance with the operational case c) in FIG. 3.

FIG. 4 compares the effect on the sound level f (Hz) of the guide vane arrangements according to FIGS. 3*a* and 3*c*. It will be seer that there is a considerable lowering of the tone at the blade frequency f (Hz) 160 Hz of about 3.5 dB, while there is an increase o the wide band high frequency noise over about 500 Hz. The operational conditions are the same as for FIG. 1.

Figure 3D:
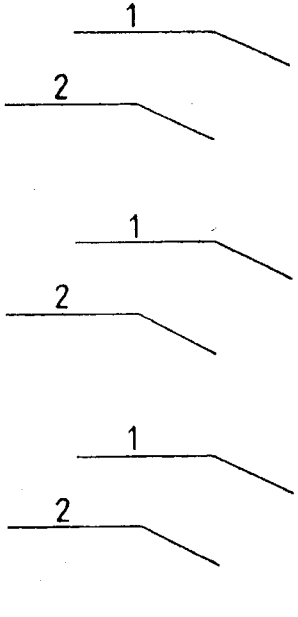
Figure 5:
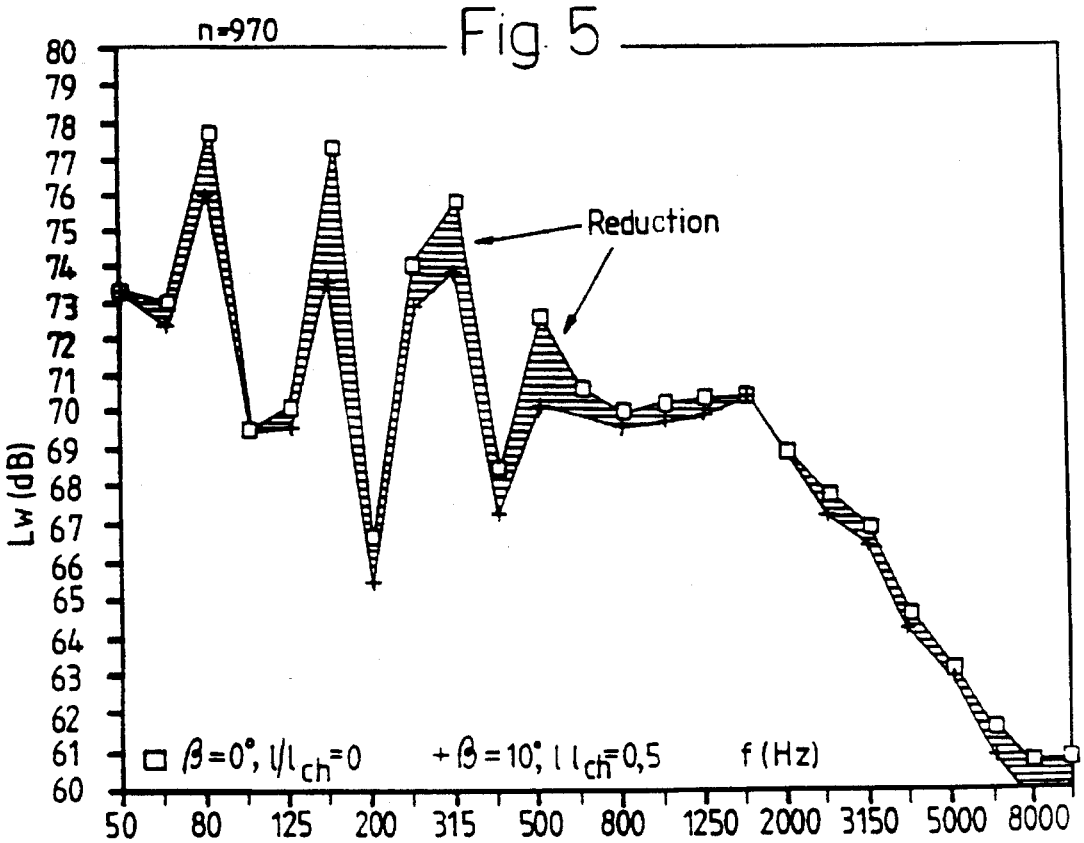
FIG. 5 illustrates the effect on the sound level from the fan of the combination of axial displacement and displacement of the guide vanes in the circumferential direction of the guide vane ring according to the operational case d) in FIG. 3

In FIG. 5 the sound levels for the guide vane arrangements according to FIGS. 3*a* and 3*d* are compared. A surprising result will be seen from this figure in that the combination of axial displacement and rotation (i.e., being out of alignment) in the circumferential direction of the ring of alternate guide vanes leads to a reduction of the sound level over the entire frequency range, compared with a conventional guide vane arrangement with uniformly distributed guide vanes. FIG. 5 demonstrates that both discrete tones at lower frequencies and the wide band high frequency noise are antenuated in an embodiment according to FIG. 3*d*. The axial displacement of the guide vanes is $l/l_{ch}=0,5$, where l denotes the magnitude of the displacement and $l_{ch}$ the length along the guide vane, i.e. the displacement amounts to half the length of the guide vane. Rotation in the circumferential direction amounts to 10°. The curves are measured for a fan R.P.M. of n=970.

Figure 6:
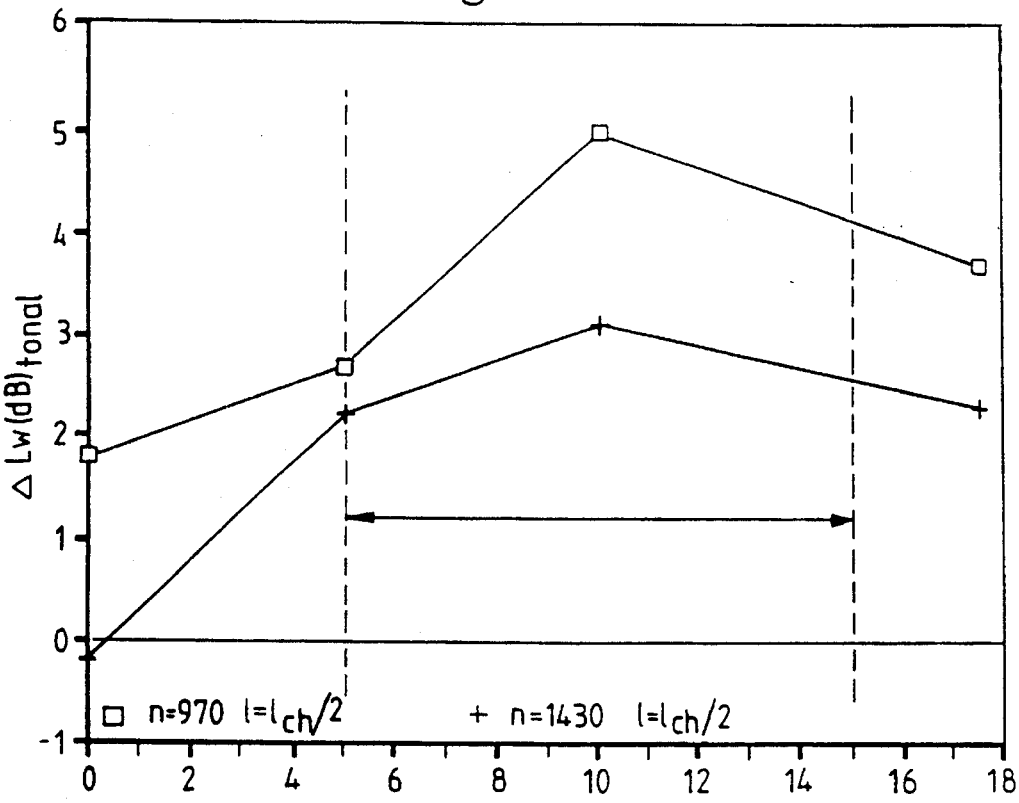
FIG. 6 illustrates the reduction of sound in the tone at the blade frequency as a function of the rotation in the circumferential direction for a given axial displacement of the guide vanes.

In FIG. 6 there is illustrated the attenuation $\Delta L_W$ at the blade frequency, as a function of the rotation B of alternate guide vanes in a guide vane arrangement where the alternate guide vane is also axially diplaced by half the length of the guide vane. The graphs are shown for two different revolutionary velocities of the fan, namely n=970 rpm, and n=1430 rpm. This diagram shows that a considerable reduction of tonal components is achieved in the angle range 5°–15° for the axial displacement of the guide vanes that is under consideration. Measurements have also shown that some improvement in aerodynamic efficiency of the fan in the region where the best sound attenuation is achieved.

Figure 3E:
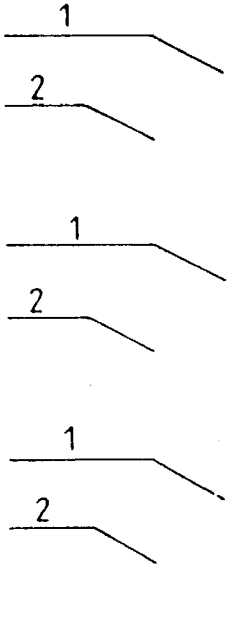

Another acoustically advantageous embodiment of the apparatus according to the invention is illustrated in FIG. 3*e*. In this embodiment a portion of the end part facing towards the impeller of alternate guide vanes is concave, so that the forward edge of these guide vanes is at a first axial distance from the impeller and the remainder at a second axial distance. In addition, the guide vanes are non-uniformly distributed round the circumference of the ring.

Figure 7:
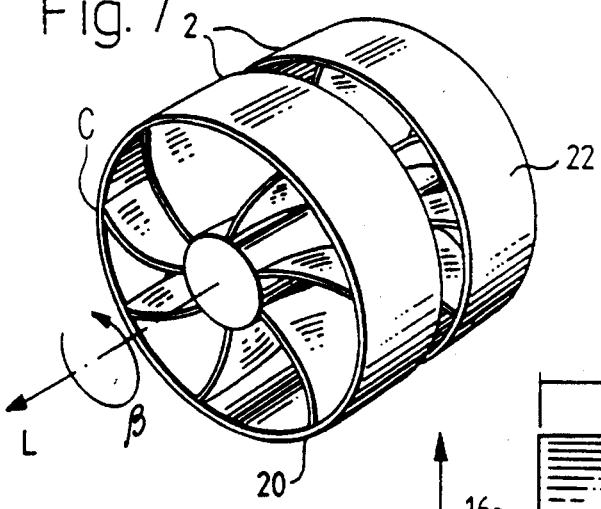
FIG. 7 illustrates an embodiment of the arrangement where two guide vane rings are used and FIG. 8 illustrates a particular guide vane configuration.

In FIG. 7 there is illustrated a further advantageous embodiment of the guide vane ring 2 in the apparatus in accordance with the invention. The ring 2 includes two rings 20,22 mounted on a common shaft. Here, alternate guide vanes are carried by one of the two rings and the other by the other ring. The two rings are mutually axially displacable and relatively rotatable about the common shaft. With this embodiment of the guide vane ring 2 there is enabled in a simple way the axial displacement and rotation along the circumference of the guide vanes relative each other so that desired properties are achieved.

Figure 8:
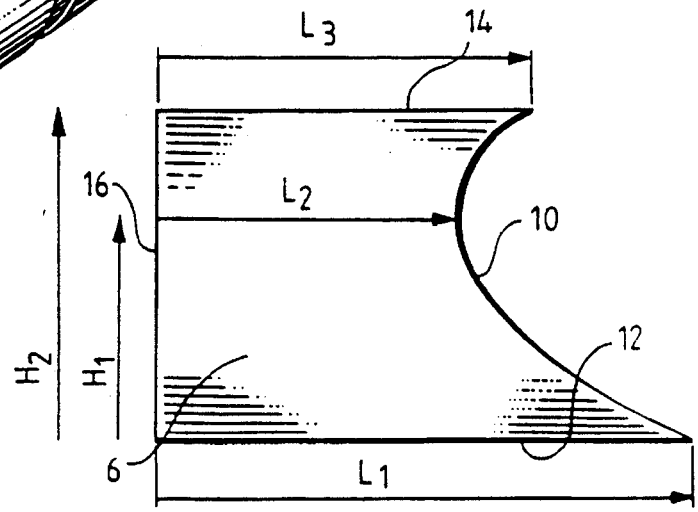

FIG. 8 illustrates an embodiment of a guide vane 6, which is found to be advantageous in the arrangement according to the invention. The end portion of the guide vane 10, which is intended to face towards the impeller has an edge 10 with a parabola-like configuration, so that between the inner and outer longitudinal edges 12 and 14 of the guide vane 6 there is a web with a shorter length $L_2$ along the guide vane than said edges $L_1$ and $L_3$, respectively. The guide vane has a straight back edge 16. If the height of the web from the inner longitudinal edge 12 is denoted by $H_1$ and the total height of the guide vane by $H_2$ the position of the web is determined by the condition:

$$0.4<H_1/H_2<0.9,$$

and preferably $$0.5<H_1/H_2<0.8$$

We claim:

1. Guide vane arrangement of axial fans, the arrangement translating the rotational component of the gas flow velocity after passage through the impeller (1) into a substantially axial velocity, which comprises:

a ring (2) of guide vanes arranged downstream of the impeller and in spaced relationship therewith, wherein alternate guide vanes with an edge facing the impeller are axially displaced relative to remaining guide vanes and wherein alternate guide vanes are located a first axial distance from the fan and the remaining guide vanes are located at a second axial distance from the fan, and the guide vanes are non-uniformly distributed along a circumference of the ring.

2. Arrangement according to claim 1, wherein a portion of an end part facing towards the impeller (1) of the alternate guide vanes is concave so that the forward edge of said guide vanes is at a first axial distance from the fan and the remainder of the guide vanes is at said second axial distance from the fan.

3. Arrangement as claimed in claim 2, wherein the alternate guide vanes are out of alignment in the circumferential direction relative the remaining guide vanes, with a constant displacement, so that the distance in the circumferential direction between adjacent guide vanes varies between two given values.

4. Arrangement as claimed in claims 1 or 2, wherein the axial displacement between the alternate guide vanes and the remaining guide vanes is in an interval of $l/l_{ch}$=0.40–0.7 where l denotes the magnitude of the displacement and $l_{ch}$ denotes the length of the guide vane.

5. Arrangement as claimed in claim 2, wherein the angular displacement in a circumferential direction has an interval of 5°–15°.

6. Arrangement as claimed in claim 1, wherein the guide vane ring (2) comprises first and second rings (20, 22) positioned axially in tandem wherein said alternate guide vanes are carried by said first rings and the remaining guide vanes by said second ring, and wherein said first and second rings are mutually axially displaceable and/or radially rotatable relative each other about a common axis.

7. Arrangement as claimed in claim 1, wherein the guide vanes, in a part facing towards the fan, are formed with a web between radially outer and inner portions of the guide vanes, and wherein an arcuate length at the level of the web is shorter than at said outer and inner portions.

8. Arrangement as claimed in claim 1, wherein the number of guide vanes is between 0.5 and 2.1 times the number of blades of the impeller.

9. Arrangement as claimed in claim 4, wherein $l/l_{ch}$=0.5.

10. Arrangement as claimed in claim 3, wherein the angular displacement in the circumferential direction has an interval of 10°.

11. Arrangement as claimed in claim 4, wherein the angular displacement in the circumferential direction has an interval of 10°.

* * * * *

UNITED STATES PATENT AND TRADEMARK OFFICE

CERTIFICATE OF CORRECTION

PATENT NO. : 5,470,200
DATED : November 28, 1995
INVENTOR(S) : Vladimir TUPOV et al.

It is certified that error appears in the above-indentified patent and that said Letters Patent is hereby corrected as shown below:

On the title page, Item [75], the second inventor's first name, should read:

-- Patrik--

Signed and Sealed this

Twenty-seventh Day of February, 1996

*Attest:*

*Attesting Officer*

Bruce Lehman

BRUCE LEHMAN

*Commissioner of Patents and Trademarks*